US006068898A

United States Patent [19]

Oyama

[11] Patent Number: 6,068,898

[45] Date of Patent: May 30, 2000

[54] SHEET FILMS, PACKAGING MATERIALS, AND PACKAGING USING THE SAME HAVING PRESSURE CONTROL VALVE

[75] Inventor: Yoshio Oyama, Kayagasaki, Japan

[73] Assignee: Hitoshi Omoto, Japan

[21] Appl. No.: 08/899,723

[22] Filed: Jul. 24, 1997

[30] Foreign Application Priority Data

Nov. 13, 1996 [JP] Japan ..... 8-318641

[51] Int. Cl.[7] ..... B65D 33/01

[52] U.S. Cl. ..... 428/35.2; 428/35.7; 428/138; 426/107; 426/118; 426/127; 383/103

[58] Field of Search ..... 383/103, 100; 426/118, 127, 106, 107; 220/367.1; 428/35.7, 137, 138, 35.2; 206/531, 532

[56] References Cited

U.S. PATENT DOCUMENTS

| | | | |
|---|---|---|---|
| 3,507,443 | 4/1970 | Coerard | 383/103 |
| 3,628,720 | 12/1971 | Schmedding | 383/103 |
| 3,659,584 | 5/1972 | Doyle et al. | 126/369 |
| 4,134,535 | 1/1979 | Barthels et al. | 383/103 |
| 4,371,080 | 2/1983 | Haines | 206/531 |
| 4,404,241 | 9/1983 | Mueller et al. | 383/103 |
| 4,689,936 | 9/1987 | Gaikema et al. | 426/118 |
| 4,834,247 | 5/1989 | Oshima et al. | 426/107 |
| 4,899,976 | 2/1990 | Cederoth et al. | 206/531 |
| 5,012,061 | 4/1991 | Lesser | 220/367.1 |
| 5,326,176 | 7/1994 | Domke | 383/103 |
| 5,387,781 | 2/1995 | Berkoff | 426/118 |
| 5,587,192 | 12/1996 | Beizermann | 383/103 |

FOREIGN PATENT DOCUMENTS

| | | |
|---|---|---|
| 0 597 741 A1 | 5/1994 | European Pat. Off. . |
| 2 695 110 | 3/1994 | France . |
| 63-49187 | 3/1988 | Japan . |
| 63-307085 | 12/1988 | Japan . |
| Y2 63-49187 | 12/1988 | Japan . |
| 64-25593 | 1/1989 | Japan . |
| Y2 1-25593 | 7/1989 | Japan . |
| 6-329179 | 11/1994 | Japan . |
| B2 7-22547 | 3/1995 | Japan . |
| 7-225470 | 8/1995 | Japan . |

*Primary Examiner*—Rena L. Dye
*Attorney, Agent, or Firm*—Griffin, Butler, Whisenhunt & Szipl, LLP

[57] ABSTRACT

A film sheet having a pressure valve portion with one or more holes passing partially through the sheet film on one side of the sheet film, and a thin portion covering each of the one or more holes. The thin portion is preferably constructed to rupture when a predetermined maximum sustainable pressure differential is applied across the sheet film. In one embodiment, sheet film has a first film layer; and a second film layer, having one or more through holes, laminated to the first film layer. In another embodiment, the sheet film has a first film layer, a second film layer having one or more through holes, and a third film layer having one or more through holes, wherein the second film layer is laminated on one side of the first film layer, and the third film layer is laminated on the other side of the first film layer so that the one or more through holes of the second film layer are aligned with the one or more through holes of the third film layer. The sheet film can be used to make sealed packages for containing foods and beverages.

6 Claims, 7 Drawing Sheets

(a)

(b)

(a)

(b)

SHEET FILMS, PACKAGING MATERIALS, AND PACKAGING USING THE SAME HAVING PRESSURE CONTROL VALVE

BACKGROUND OF THE INVENTION

1. Field of the Invention

The present invention relates to sheet films having pressure control valve portions therein, a packaging material comprising said sheet film, and packages including packages for various drinks and foods, comprising the sheet film and the packaging material. The package of the present invention is a package wherein foods and beverages can be stored and a simply cooked in a cooking device such as a microwave oven. More specifically, the sheet or film of the present invention relates to a sheet film having two or three layers comprising a first film layer and second, and if necessary third film layers having one or more holes. The sheet film having a pressure valve portions can also comprise a single layer having one or more holes passing partially through the sheet film on one side, and a thin portion covering each of the one or more holes. Also in accordance with the invention, a packaging material is formed with the sheet film, and packages, including sealed packages for foods and beverages are made using the packaging material. The package material of the invention is capable of releasing pressure when a predetermined pressure is reached inside the package, or a maximum sustainable pressure differential across the sheet film is exceeded.

2. Description of the Background Art

Current eating habits are undergoing great changes. Particularly, the use of precooked foods and beverages and semi-cooked foods and beverages is increasing. One example is frozen foods, also called retort foods, wherein cooked food is put in a container and then kept frozen. Frozen foods typically only require heating to be ready for eating. The number of foods and beverages which can be cooked in a short period of time and with ease by using microwave ovens and other cooking apparatuses is increasing.

Sheet films for packaging foods and beverages include sheet materials made of synthetic plastic films, paper, metallic foils, or a sheet material having a multi-laminated structure of such materials. The material properties and functions of such packages differ depending on their objectives, such as, preservation, storage, transportation, distribution, display, and depending on the method and type of maintaining freshness, the environment of the foods and beverages, as well as whether the foods and beverages are fresh or processed. Therefore, it is necessary to select and use appropriate packaging materials having material properties and configuration in conformity with such objectives.

When cooking apparatuses, such as microwave ovens or electro-magnetic cookers are used to rapidly heat packaged foods and beverages, the problem of having a rapid increase in pressure is encountered. In this case, as a pressure safety measure, a method is commonly employed wherein a hole is provided in part of a package, the hole is sealed by a seal having an adhesive, and then the seal is pealed off before heating in a microwave oven and the like. In another commonly employed method, a hole is provided in a package and a seal having a pressure regulation valve function is provided in the hole. In a further method, portions having a high melting point and low melting point are provided in the seal portion of a package whereby when the portion having a low melting point melts to release the pressure. Lastly, there is a method wherein a hole is made in a package or a portion of a package is cut before the package is heated in a microwave oven or the like.

For example, package containers to be used in making popcorn in a microwave oven are disclosed in Utility Patent Publications Sho. 63-49187 and Hei. 1-25593. These containers are obtained by putting corn, edible oil and spices in a holding plate made of paper followed by sealing this holding plate with packaging materials made of synthetic plastic films. When the corn which is packed and sealed by a film is subjected to irradiation by a microwave oven, the corn is heated to become popcorn. In this case, a small hole for ventilation can be provided at the joined portion of the film, whereby explosion of the package can be avoided by releasing the pressure accumulated inside of the package through the hole.

When a sealed package container is heated, the pressure inside generally increases. A package for foods and beverages is known which makes it possible to cook foods and beverages in a short period of time by using a microwave oven. Namely, in Japanese Patent Publication Hei. 7-22547 and Japanese Laid-Open Patent Hei. 6-329179, a package for foods and beverages is disclosed wherein sheet type pressure regulation valves are joined to a package for foods and beverages whereby such pressure regulation valves are opened to make it possible to regulate the pressure inside of the package when the pressure inside of the package becomes higher than a specified pressure.

However, although the pressure increase inside of the package can be actually avoided by such prior art packages for foods and beverages, in reality, it is not possible to regulate the pressure in a precise way. In the case of popcorn, popcorn of the same quality can not be easily obtained due to the difference of the pressure increase in each package during irradiation in the microwave oven, because uniformity in the size of holes provided in each package can not be easily obtained, and, in the extreme case, the diameter of the holes differs from package to package. Furthermore, when a sheet type pressure regulation valve is employed, the cost may increase due to the increased production processing for the manufacture of pressure regulation valves, and the workmanship and taste of the foods and beverages after being cooked may differ from package to package. This difference may be due to variations, such as the minute variation of the attached position of the sheet type regulation safety valve, or variation of the adhesive strength between the regulation safety valve and the sheet.

The present invention provides, at a low cost, a sheet for packaging suitable for various different objectives, a packaging material using the same, and packages, including sealed packages for foods and beverages. Particularly, the present invention provides a sheet packaging material and packages for foods and beverages using the sheet, which eliminate the above-mentioned problems of prior art packages for foods and beverages. More particularly, the present invention provides a sheet material of reliable quality, which is easy and inexpensive to manufacture into packaging materials.

The present invention relates to packages for foods and beverages to be used in various processing treatments, such as retort, cook-chilled, cook-serve, cooking in vacuum, and freezing, wherein the package has a pressure regulation valve function as well as the conventional packaging function. One example of the application of the present invention is a package wherein a heating environment suitable for each package of food and beverage can be provided when rapid heating is employed by using a microwave oven or an electromagnetic cooker. In such a package, foods and beverages can be heated without causing any unevenness in the temperature and at the same time the pressure due to the heating can be automatically regulated. Another example of the present invention is a package for foods and beverages wherein fresh foods and beverages, and spices, if desired, can be cooked in an appropriate environment, such as the heating temperature, humidity, pressure and time, inside of the package.

SUMMARY OF THE INVENTION

In accordance with the above objects, the present invention provides a sheet film having a pressure valve portion comprising one or more holes passing partially through the sheet film on one side of the sheet film, and a thin portion covering each of the one or more holes. The thin portion is preferably constructed to rupture when a predetermined maximum sustainable pressure differential is applied across the sheet film.

In one embodiment, the sheet film comprises a first film layer; and a second film layer, having one or more through holes, laminated to the first film layer.

In another embodiment, the sheet film comprises a first film layer, a second film layer having one or more through holes, and a third film layer having one or more through holes, wherein the second film layer is laminated on one side of the first film layer, and the third film layer is laminated on the other side of the first film layer so that the one or more through holes of the second film layer are aligned with the one or more through holes of the third film layer.

Also in accordance with the above objects, the present invention provides a sealed package comprising the above sheet film, and a sealed package comprising the sheet film and containing foods and beverages.

Further objects features and advantages of the present invention will become apparent from the Detailed Description of the Preferred Embodiments, which follows, when considered together with the attached drawings.

Figure 1:
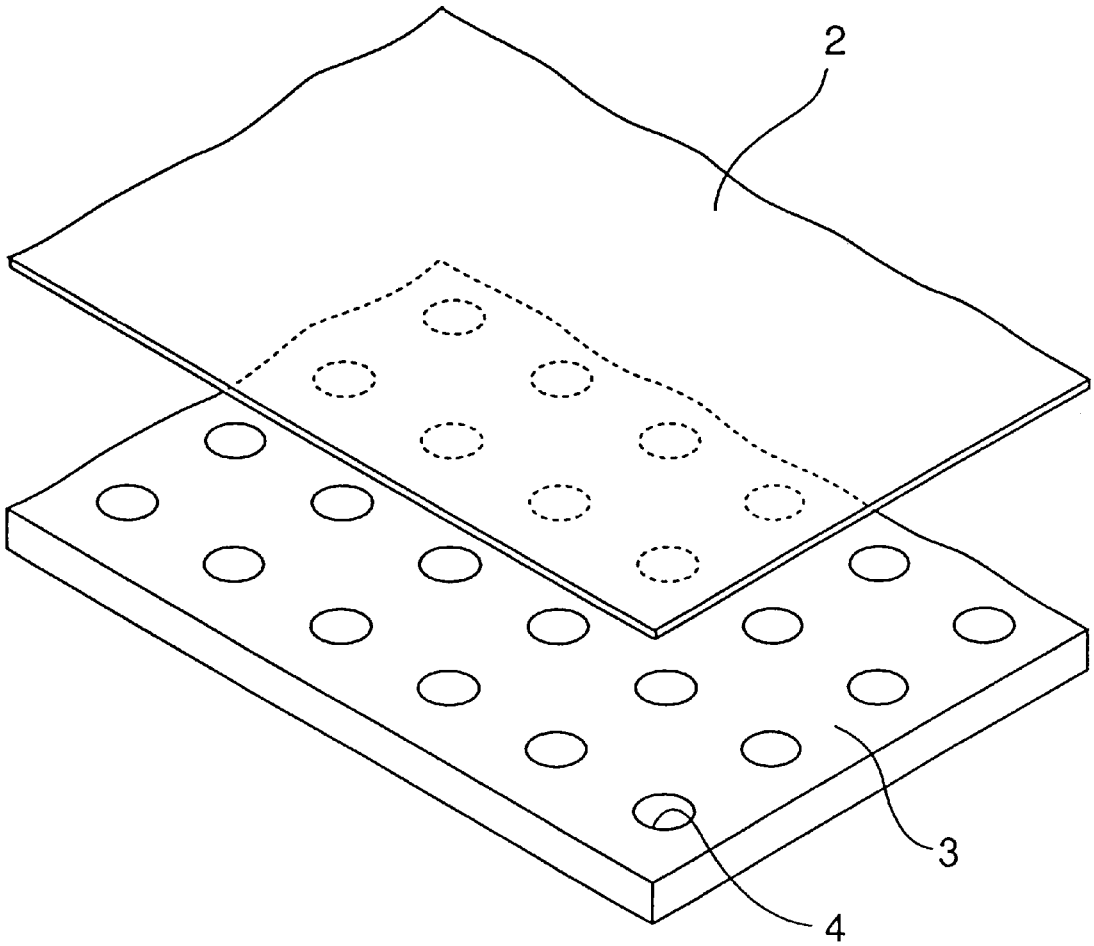
FIG. 1 shows a perspective view of an assembled film sheet comprising two layers.

In the drawings, the reference numerals have the following meanings:

1 Two layered film sheet
2 Film having no hole
3, 3' Film having holes
4, 4' Hole
5, 5' Adhesive layer
6 Single layered film
7 Thin portion
10 Three layered film sheet
14 Ingredient
15 Package
16 Package
17 Container
20, 21 Region having a pressure regulation function

DETAILED DESCRIPTION OF THE PREFERRED EMBODIMENTS

The gist of the present invention resides in a laminated film sheet comprising a first film layer having no holes and a second film layer having through holes. This film sheet may comprise two layers, a first film layer having no holes and a second layer film layer having through holes, and it may also comprise three layers, wherein two film layers having through holes are laminated on either side of a first film layer having no holes. In another embodiment, the invention comprises a sheet film comprising a single layer while being materially the same in structure with the foregoing two layered sheet film and having thin portion on its surface. Furthermore, the invention also contemplates a packaging material comprising such sheet films and in packages and sealed packages for foods and beverages comprising the packaging materials.

FIG. 1 shows a perspective view after assembly of a sheet film of the present invention having two layers. Namely, this can be obtained by laminating a sheet film 3 having holes 4 onto a sheet film 2 having no holes.

Figure 2:
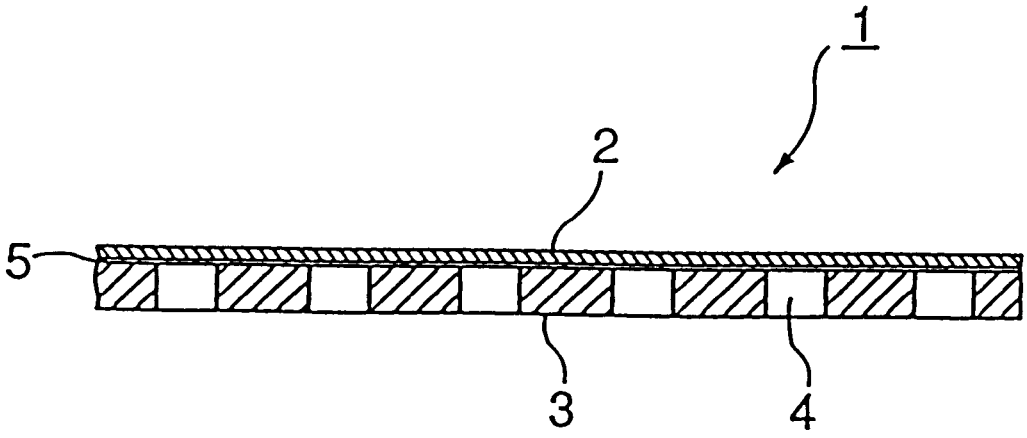
FIG. 2(*a*) shows a cross-sectional view of a film sheet comprising two layers, and FIG. 2(*b*) shows a plan view thereof.
Figure 2:
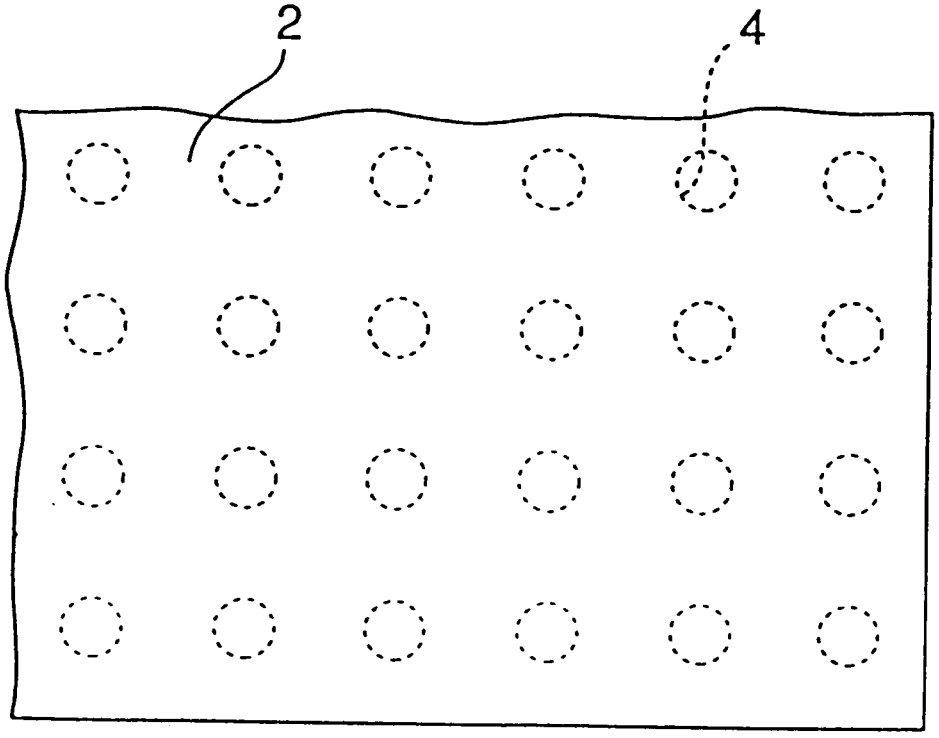

FIG. 2 shows a schematic representation of a cross section of the sheet film 1 comprising two layers according to the present invention, and FIG. 2(*b*) shows the plan view thereof. The sheet film 1 having two layers may be obtained by laminating the film 3 having the holes 4 on the film 2 having no holes. The film layers 2 and 3 are joined by the adhesive layer 5.

Figure 3:
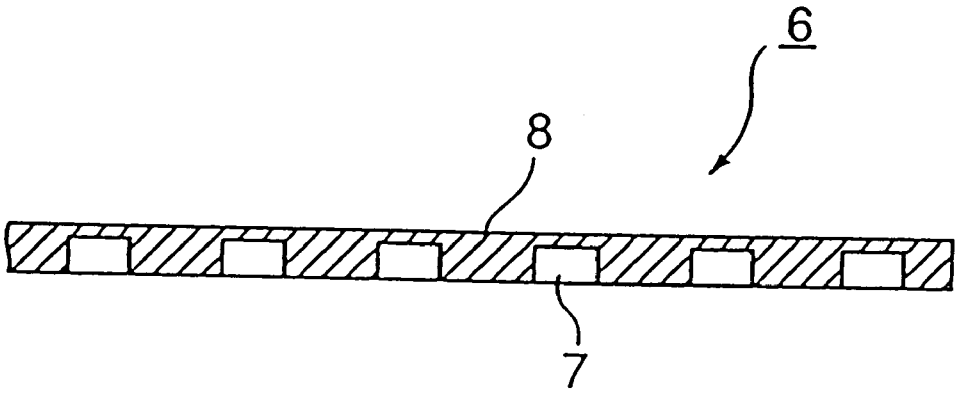
FIG. 3 shows a cross-sectional view of a film sheet comprising one layer.

FIG. 3 shows a cross sectional view of the sheet film 6 comprising a single layer. The thin portion 7 is provided on the film surface. Sheet film 6 is so made that upon application of a pressure differential across the sheet, thin portion 7 can rupture. Thus film 6 provides substantially the same function as that of the sheet film 1 having two layers. That is, a pressure release valve portion is defined by the thin portion 7.

Figure 4:
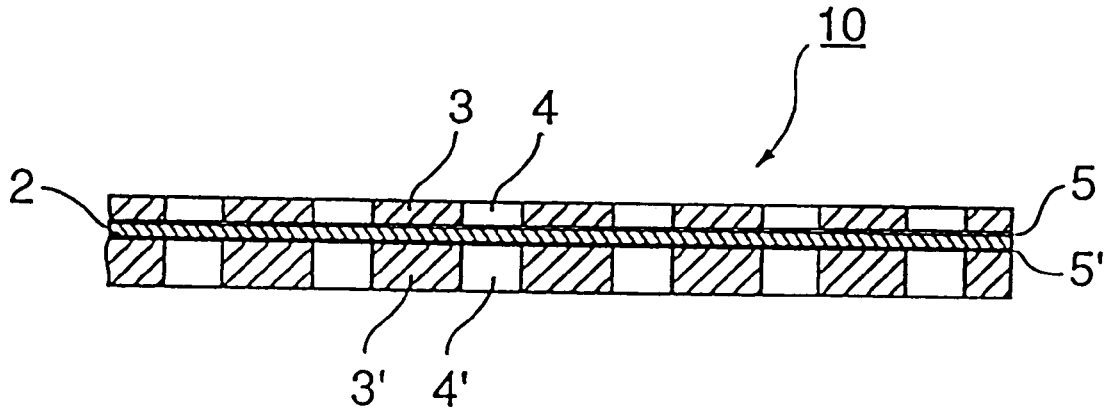
FIG. 4 shows a cross-sectional view of a film sheet comprising three layers.

FIG. 4 shows a cross sectional view of the sheet film 10 comprising three layers according to the present invention. This sheet film is obtained by laminating films 3 and 3' having holes 4 and 4', respectively. Each film layer is joined by adhesive layers 5 and 5' respectively. In this case, the films are laminated in such a way so as to have the hole 4 of the film layer 3 and the hole 4' of the film layer 3' be aligned in the direction of the film thickness. The configuration of the hole is not particularly limited, but a smooth configuration, such as a circle or ellipse is preferable from the point of providing effective and stable function of the thus-formed safety regulation valve structure.

As for the raw material of the film to be used in the present invention, polyethylene, polypropylene, polyester, nylon, polyvinyl chloride, polyvinylidene, polystyrene and the like may be employed. And such films may by employed as films having no holes as well as materials for films having holes. The lamination of these films may be achieved by any suitable lamination method.

Effective lamination methods include: 1) a wet lamination method wherein an adhesive is coated on one side of a first film and then a second film to be laminated is laid on the coated side of the first film, followed by rolling or the like whereby the first and second films are joined under pressure and then dried; 2) a dry lamination method wherein an adhesive is coated on one side of a first film, the solvent of the adhesive is then removed by drying, and a second film is then laminated on the first film; 3) a hot melt lamination method wherein a 100% solid adhesive having no solvent is coated in a melted condition on a first film and a second film is then laminated on the first film under pressure; and 4) an extrusion lamination method wherein after a plastic is extruded in a form of a first film by an extruder, a second film is joined to the first film under pressure, and the joined films are then cooled to make a laminate.

The single layered sheet film 6 as shown in FIG. 3 may be manufactured, for example, by an emboss forming process wherein a mold with a trapezoidal projection provided on an ordinary films pressed against a sheet film.

The laminated sheet film or a sheet film having thin portions according to the invention may be used as a packaging material. Furthermore, various packages may be manufactured by using the packaging material according to the invention. Needless to say, sealed packages for foods and beverages are included in such packages according to the present invention.

A package for foods and beverages according to the present invention is obtained when a film according to the invention is made into a shape of bag whereby foods and beverages are put inside and the bag sealed. As for the foods and beverages, fresh foods like fish, meat, frozen fish and meat, raw materials like vegetables and noodles, processed foods like Chinese buns or beef stew and processed frozen foods, and other types of food may be used. The package for foods and beverages of the present invention will be sufficiently useful in the transportation, storage and preservation of the food as well as for display in store fronts.

When a sheet film comprising two layers according to the invention is used, there are two methods of putting food and beverages in a bag made by the packaging material of the present invention. In the first method, a first film having holes is laminated facing toward the inside of the bag containing the food and beverages, and in another case, a film having no holes is laminated facing toward the inside of the bag containing the food and beverages, and either one of these cases can be employed. In the case of a single layered sheet film having a thin portion, there are two embodiments wherein the surface having a concave portion faces either outside or inside, and either one of these embodiments can be employed. In the case of a triple layered film according to the invention, orientation of the film is not a factor that needs to be considered.

Furthermore, the package for food and beverages according to the present invention has the function of an automatic cooker. When the package for food and beverages of the present invention is subjected to a processing in a microwave oven and the like, the temperature gradually increases. The pressure increases further after the temperature has reached the most favorable temperature for the food and beverages inside of the package. Thereafter, the portion of the film layer according to the present invention having the lowest tensile strength ruptures. In the two layer embodiment, the portion of the film layer having no holes, adjacent to the holes of the film layer having holes is the portion having lowest tensile strength. As the film ruptures, pressure is released, whereby it is made possible to cook the food and beverages at the most favorable temperature and pressure. As the result, stable quality and also excellent workmanship may be obtained in food and beverages cooked using the packaging of the present invention.

Figure 5:
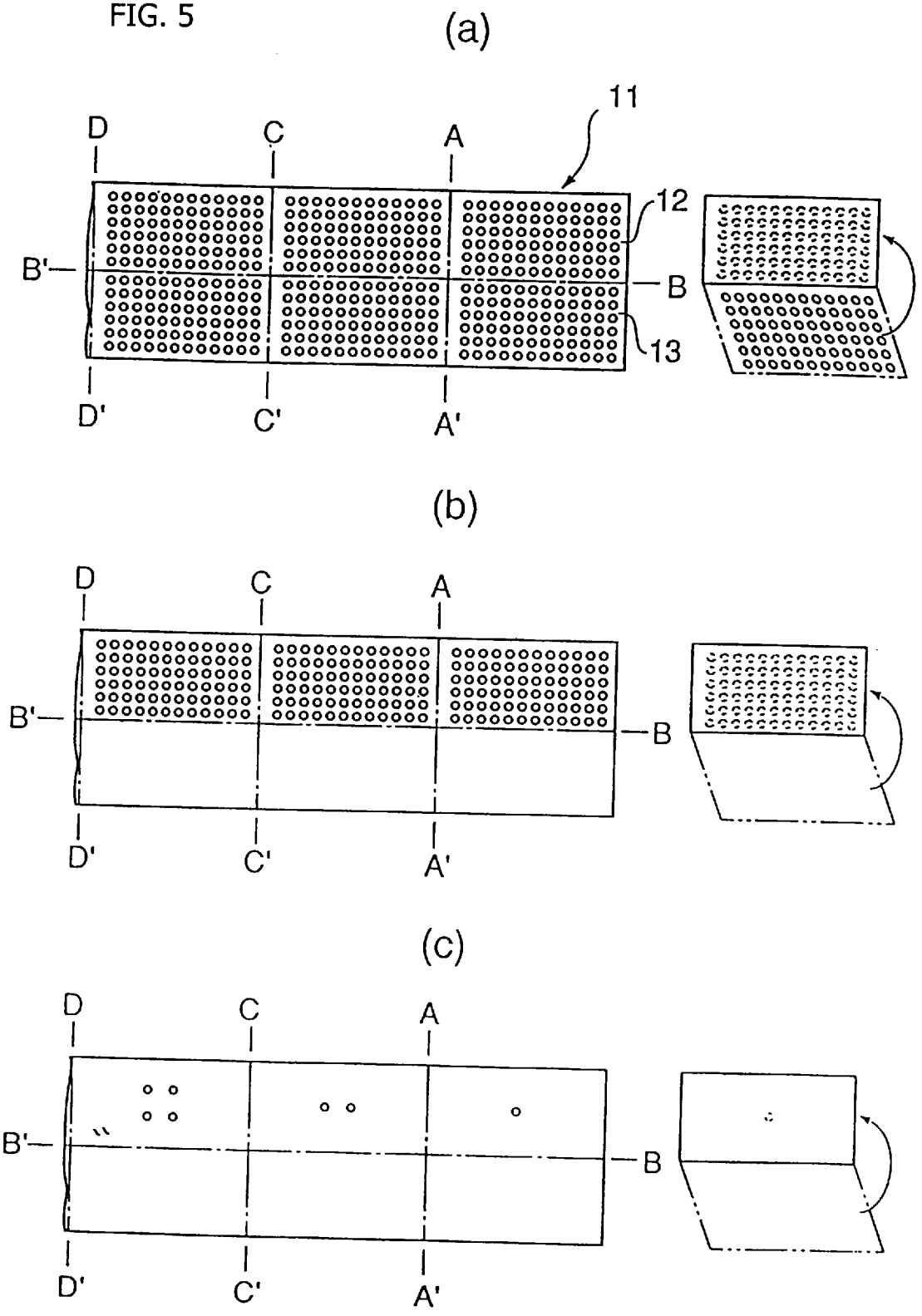
FIG. 5 shows an embodiment of the construction of a film sheet.

The sheet film can be provided in various configurations. For example, the configuration as shown in FIG. 5 can be employed. FIG. 5(*a*) shows a sheet film wherein holes 4 are conveniently provided on the entire surface of the sheet film. FIG. 5(*b*) shows a sheet film wherein holes 4 are provided in one side of the center line B, B' in the sheet film. FIG. 5(*c*) shows a unit region when the sheet film is used as a packaging material, and, in this case, a predetermined number of holes is provided in the area designated by A, A', C, C', or D, D'. The size and quantity of these holes are determined depending on the contents to be put inside of the package made of said packaging material. Incidentally, the area cut off along the lines of A, A', C, C', D, D' is used as one unit area to make the packaging bag.

The sheet film is cut off along the lines A, A', C, C', and D, D' to be made into a packaging material. The cut off material is folded along the line B, B' and can be used for various packages by sealing it along its edges by a suitable joining method such as melting joining and adhesive joining to thereby, for example, make the material into a bag, whereby it can be used as various types of packaging. Each figure shown to the right hand of FIGS. 5(*a*), 5(*b*), 5(*c*) shows a schematic view of the bag made in such a way. Even in the embodiment according to the invention of a single layered sheet film having a thin portion, a sheet similar to that obtained in the foregoing method, namely, a sheet with the area surrounding the hole being concave can be obtained.

Figure 6:
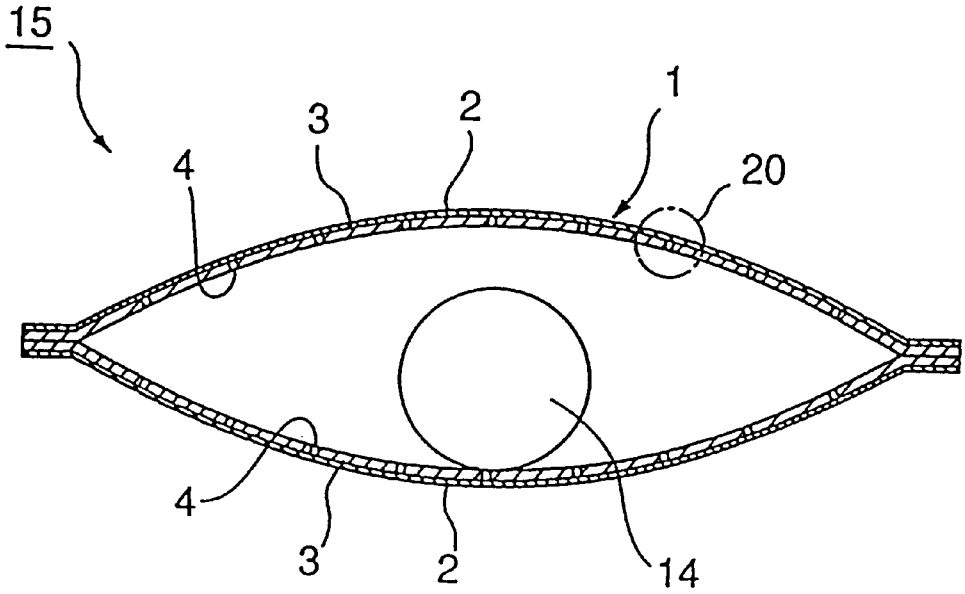
FIG. 6 shows an embodiment of the construction of a package.
Figure 6:
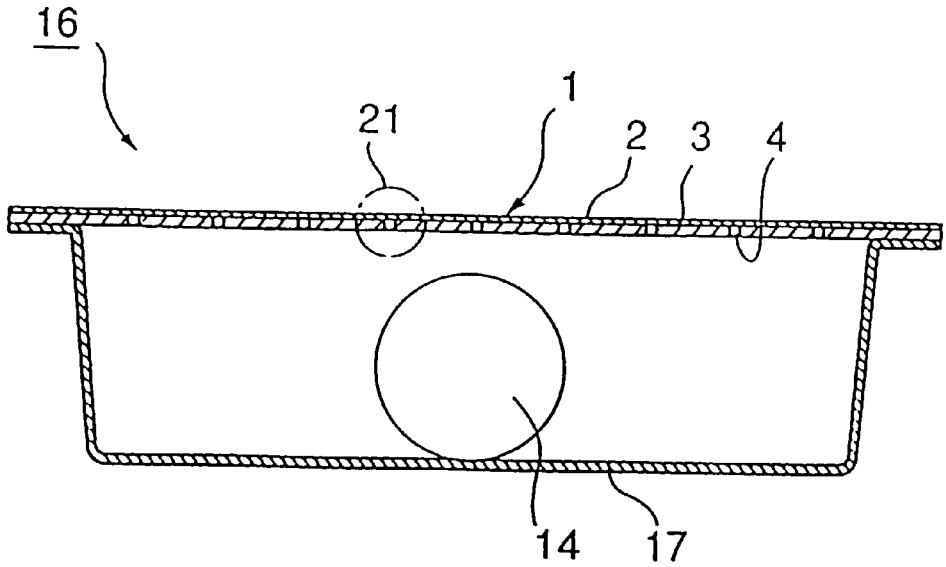

Furthermore, a similar package according to the present invention can be obtained by covering other containers with the packaging material of the present invention. For example, FIG. 6(*a*) shows a package made by a packing material comprising a sheet film according to the present invention. FIG. 6(*b*) shows a package made by covering a container, made by other materials, for example, plastic, paper, China, and metal such as aluminum, with the sheet film of the present invention.

Figure 7:
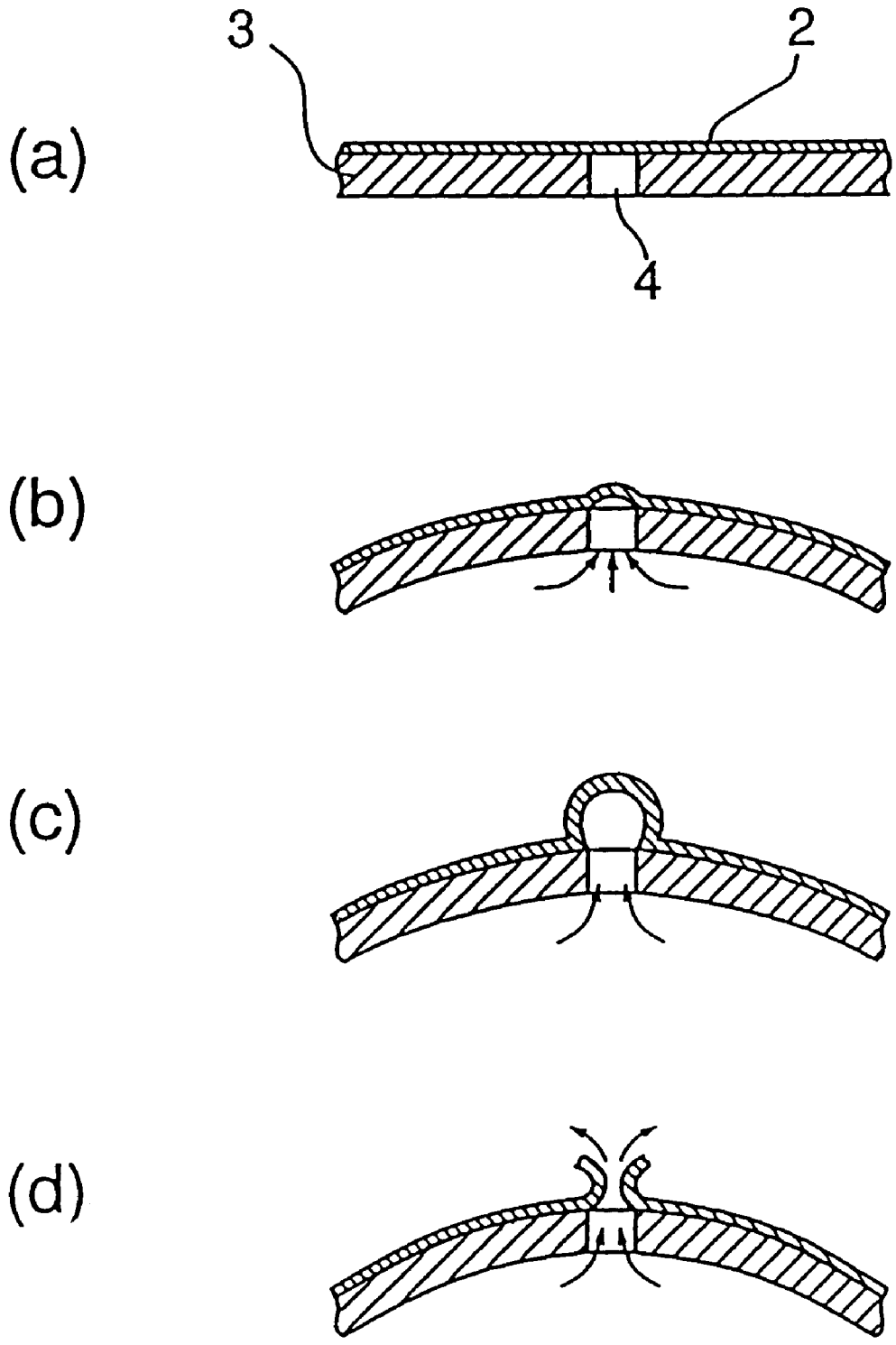
FIG. 7 shows a mechanism of the pressure regulation valve portions.

The function of the present invention will be explained hereunder with reference to FIG. 7. FIG. 7 illustrates the functioning of a two layer sheet according to the present invention. The packing material of the present invention, at the time when a package for food and beverages made of the material is put inside of a microwave oven, eg., before any change takes place, is as shown in FIG. 7(*a*). When the temperature inside of the package for food and beverages increases with elapsed time, the pressure inside of the package increases, and the film layer having no holes expands outwardly at the region of holes 4 as shown in FIG. 7(*b*). That is, the area in the film of greatest structural weakness expands. Thereafter, the pressure inside of the package increases still further, and when the maximum pressure sustainable by the film is reached, the package further expands as shown in FIG. 7(*c*). The film layer 2 eventually ruptures after the maximum sustainable pressure is reached, and the pressure inside the package is thereby released. See (FIG. 7(*d*)).

The value of maximum sustainable pressure at which the pressure is released depends on the material properties and thickness of the film 2 having no holes and also on the size and configuration of the holes provided in the film 3. By selecting these variables properly, a sheet type packaging material capable of releasing the pressure at any desired value of pressure can be obtained. As explained above, the sheet type material of the present invention is inherently provided with pressure regulating valve portions.

When a package made with a sheet film having the pressure regulation valve portion of the present invention is placed and heated inside of a microwave oven after various food and beverages are put inside the package and the package sealed, the food and/or beverages are gradually heated and the moisture retained in the contents gradually starts to evaporate. The evaporating moisture increases with the elapsed time of heating. In this case, each material, such as water soluble material, oil, fiber, pulp (including, but not limited to, carbohydrates) undergoes evaporation in proportion to the amount and duration of heating. Oil generally does not undergo any expansion because of its high boiling point, but instead it oozes out from the ingredients in proportion to the pressure. Fiber and pulp undergoes changes depending on the amount and duration of the heating and the resulting temperature.

The problem encountered in the process of cooking in a microwave oven and the like is the fact that the shape, configuration, volume and specific surface area of the ingredients or the amount of fats contained therein vary. Another problem is that in a microwave oven, the energy tends to be concentrated in the portion where the cross sectional area is small and the water content is low due to the characteristic properties of microwaves. Therefore, it becomes extremely difficult to uniformly heat ingredients having different configurations, volumes, water contents and the like.

On the contrary, because the package for food and beverages of the present invention is sealed and the temperature of the ingredients increases rapidly, the heat is not released from the package, evaporated vapor moves from high temperature portions to lower temperature portions, and uniform heating in a short period of time can be effected. When the ingredients are uniformly heated, and the temperature further increases, the pressure also increases. When the pressure reaches a value more than the maximum tolerable pressure of the package, as explained with reference to FIG. 7, the safety regulation valve function according to the present invention is achieved. That is, when the sheet film 1 is used, the film layer 2 having no holes is ruptured at the hole 4, whereby excess pressure inside of the package is released, and further rupture of the package is prevented.

However, in order to cook food and beverages, heating often needs to be continued for some time. It is thus required to strike a balance between the pressure released and the pressure remaining in the package for cooking. In other words, this objective is achieved by making the size of a hole made by rupture at the maximum sustainable pressure such as to keep a balance between the remaining pressure and the released pressure. This object can be easily obtained by selecting the size of the hole in the film layer 3 and the material properties, for example, tensile strength and thickness of the film. Thus the present invention results in a package having a safe and simple structure.

In the embodiment of the present invention shown in FIG. 2, two layers are provided wherein a nylon film is used as the film 2 having no holes and a polypropylene film is used as a film having holes. A nylon film having a high resistance to heat and a thickness of from about 0.01–0.035 mm is used for the film layer 2. A polypropylene film providing an excellent barrier and having high flexibility is used as the other film having holes. The thickness of the polypropylene film is from 0.04–0.08 mm and the diameter of the holes is from about 1–5 mm. After coating an adhesive on the polypropylene film layer, the lamination with a nylon film by a dry lamination method is effected to obtain a laminated film. If necessary, other types of synthetic plastic films, papers, synthetic papers and the like may be used for the nylon film layer depending on the requirements. In such embodiments, there are two configurations. In one, the film layer 3 having holes, i.e., the polypropylene film, is laminated on the outside and, in the other configuration, the film layer 2 with no holes, i.e., the nylon film layer, is laminated on the outside surface.

In another embodiment, with reference to FIG. 3, a polyester film or a polypropylene film is used as the material for the film. The thickness of the polyester film or polypropylene film is from about 0.03–0.05 mm. The depth at the thin portion is from about 0.02–0.04 mm. Results substantially similar to that obtained in the embodiment as shown in FIG. 2 are obtained in this embodiment.

Another embodiment is further shown in FIG. 4 wherein the film 2 having no holes is a nylon film and films 3 and 3' having holes are made of layers of polypropylene film. The thickness of the polypropylene film is from about 0.04–0.08 mm and the diameter of the provided holes is from about 1 to 5 mm. After coating the polypropylene film layer with an adhesive, a lamination with a nylon film is effected by a dry lamination method whereby a laminated film is obtained.

The invention will now be described with respect to certain Examples.

EXAMPLE 1

In the embodiment shown in FIG. 2, a film sheet was obtained wherein a nylon film having a thickness of 0.01 mm was used as a film having no holes, and a polyester film having holes in a concentration of one hole with a diameter of 4 mm per 4 $cm^2$ and having a thickness of 0.04 mm was used as a film having no holes. In this example the holes were of the type shown in FIG. 5(*a*). The film sheet was cut into a size having a 300 mm width and 300 mm length, and then folded so that a flat bag having a 150 mm width and 300 mm length was obtained by sealing a 10 mm width along all four edges.

Seventy (70) grams of spinach were put in the flat bag thus obtained and packaged as shown in FIG. 6(*a*). This package was then put in a microwave oven having a microwave output power of 500 W, and after setting the timer for 1 minute and 20 seconds, the switch was turned on. After about 40 seconds from the start of heating, the water content of the spinach itself started to gradually evaporate due to the heating, whereby the moisture diffused and filled the package and an expansion of the flat bag was observed. After one minute had elapsed, the pressure inside of the package increased to 1.3 atm and the temperature increased up to 120° C. and the package almost burst. After a while, the film layer 3 was pushed up at the hole 4 in the region 20 of a pressure regulator portion provided on the surface subjected to the largest tension on the upper side of the package, and film 3 finally ruptured because the maximum sustainable pressure had been exceeded. The excessive pressure over the predetermined maximum sustainable pressure value inside of the package was released to the outside of the package through the ruptured hole whereby the pressure and temperature inside of the package were maintained at about 1,25 atm and about 98–105° C., respectively, followed by further heating without any interruption for another 20 seconds to finish the cooking. In this example, efficient cooking of the spinach was effected in a short period of time.

EXAMPLE 2

In the embodiment shown in FIG. 2, a film sheet was obtained wherein a nylon film having a thickness of 0.02 mm was used as a film having no holes and a polyester film having holes in the concentration of one hole with a diameter of 2 mm per 9 $cm^2$ and having a thickness of 0.055 mm was used as the other film having holes. In this case, the holes were of the type shown in FIG. 5(*b*). After this film sheet was cut into a size having a width of 110 mm and a length of 140 mm, it was placed over a separately provided container made of paper having a length of 120 mm, a width of 90 mm, and a depth of 50 mm whereby a package as shown in FIG. 6(*b*) was obtained. One hundred (100) grams of raw hamburger comprising 80 g of beef, 14 g of onion, 5 g of bread powder, and 1 g of spice were placed in this container and then frozen.

After taking the package containing the frozen raw hamburger out of the freezer, the package was put in a microwave oven having a microwave output power of 500 W, the timer was set at 4 minutes and 50 seconds, and the switch was turned on. It took about 50 to 60 seconds to thaw the hamburger. After 1 minute and 10 seconds to 1 minute 30 seconds (the cumulative elapsed time was 2 minutes and 10 seconds to 2 minutes and 30 seconds) from the thawing, the water content of the hamburger itself started to gradually evaporate due to the heating, whereby the moisture diffused and filled the package and an expansion of the flat bag was observed. After a further 1 minute and 30 seconds (the cumulative elapsed time was 3 minutes and 40 seconds to 4 minutes) had elapsed, the pressure inside of the package increased to 1.5 atm and the temperature increased up to about 135° C. At that point, the package was close to bursting.

After a while, the film layer 3 was pushed up at the hole 4 in the region 21 of a pressure regulator portion provided in a surface subjected to the largest tension on the upper side of the package, and the film 3 finally ruptured because the film layer could not sustain the pressure. The excessive pressure over the predetermined maximum sustainable pressure value inside of the package was released to the outside of the package through the ruptured hole whereby the pressure and temperature inside of the package were maintained at about 1.35 atm and about 110–120° C., respectively, followed by further heating without any interruption for another 50–70 seconds. As a result, even a raw hamburger made with minced meat which is difficult to thoroughly cook was uniformly heat processed under a high moisture, temperature, and pressure atmosphere to produce a hamburger having appropriately reduced fat and having a soft feel.

EXAMPLE 3

In the embodiment shown in FIG. 4, a film sheet was obtained wherein a nylon film having a thickness of 0.035 mm was used as a film having no holes, and a polyester film having holes in the concentration of 2 holes, with the diameter of each hole being 3 mm, per each bag and having a thickness of 0.06 mm was used as the other film having holes. In this case, the holes were of the type shown in FIG. 5(*c*). This film sheet was cut into a size 320 mm in width and 220 mm in length, and thereafter folded to produce a flat bag of the type shown in FIG. 6(*a*) having a width of 160 mm and a length of 220 mm in length by sealing a width of 10 mm on all four edges of the bag. The films were laminated in such a way so as to provide each hole in the film layer aligned in a same position with respect to the direction of the film thickness. One hundred fifty (150) grams of a curry roux were put in the above flat bag and then a package was made. The package was put in a retort cooker and was subjected to a retort sterilization for about 40 minutes under a pressure of about 1.5 and a temperature of about 120–125° C., followed cooling. No change was observed in the structure of the package during this retort process.

The retort package thus obtained was put in a microwave oven having a microwave output of 500 W, the timer was set at 2 minutes and 30 seconds, and the switch turned on. After about 1 minute, the water in the curry roux itself started to gradually evaporate due to the heating, whereby the moisture diffused and filled the package and an expansion of the flat bag was observed. After a further 1 minute (the cumulative elapsed time was 2 minutes) had elapsed, the pressure inside of the package increased to about 1.6 atm and the temperature increased up to 130–135°, at which point the package was close to bursting. After a while, one of the two pressure regulators provided in an upper surface of the package was gradually pushed up, and the film ruptured at the moment when the stress caused by the pressure inside of the package became higher than the tolerable tensile strength of the film layer. The excessive pressure over the predetermined maximum sustainable pressure inside of the package was released to the outside of the package through the ruptured hole whereby the pressure and temperature inside of the package were maintained at about 1.65 atm and about 130° C., respectively, followed by further heating without any interruption for another 30 seconds. As a result, the liquid of the curry roux was subjected to a heating process under a uniform temperature whereby an acceptable curry roux having a mild taste was obtained.

While the present invention has been illustrated by means of several preferred embodiments, one of ordinary skill in the art will recognize that substitutions, additions, deletions and improvements can be made while remaining within the scope and spirit of the appended claims.

What is claimed is:

1. A sheet film, comprising a first film layer, a second film layer having one or more through holes, and a third film layer having one or more through holes, wherein the second film layer is laminated on one side of the first film layer, and the third film layer is laminated on the other side of the first film layer so that the one or more through holes of the second film layer are aligned with the one or more through holes of the third film layer to form one or more pressure valve portions.

2. A sheet film further comprising a first film layer, a second film layer having one or more through holes, and a third film layer having one or more through holes, wherein the second film layer is laminated on one side of the first film layer, and the third film layer is laminated on the other side of the first film layer so that the one or more through holes of the second film layer are aligned with the one or more through holes of the third film layer to form one or more pressure valve portions, wherein said first film layer is constructed to rupture at said one or more pressure valve portions when a predetermined maximum sustainable pressure differential is applied across the sheet film.

3. A sealed package comprising a sheet film comprising a first film layer, a second film layer having one or more through holes, and a third film layer having one or more through holes, wherein the second film layer is laminated on one side of the first film layer, and the third film layer is laminated on the other side of the first film layer so that the one or more through holes of the second film layer are aligned with the one or more through holes of the third film layer to form one or more pressure valve portions.

4. A sealed package according to claim 3 further comprising a food or beverage inside the sealed package.

5. A sealed package comprising a sheet film comprising a first film layer, a second film layer having one or more through holes, and a third film layer having one or more through holes, wherein the second film layer is laminated on one side of the first film layer, and the third film layer is laminated on the other side of the first film layer so that the one or more through holes of the second film layer are aligned with the one or more through holes of the third film layer to form one or more pressure valve portions, wherein said first film layer is constructed to rupture at said one or more pressure valve portions when a predetermined maximum sustainable pressure differential is applied across the sheet film.

6. A sealed package according to claim 5 further comprising a food or beverage inside the sealed package.

* * * * *